US005344306A

United States Patent [19]

Brown et al.

[11] Patent Number: 5,344,306

[45] Date of Patent: Sep. 6, 1994

[54] REDUCING NITROGEN OXIDES EMISSIONS BY DUAL FUEL FIRING OF A TURBINE

[75] Inventors: Donald T. Brown, Kearny, N.J.; Alexander S. Dainoff, Rockville Centre, N.Y.

[73] Assignee: Nalco Fuel Tech, Naperville, Ill.

[21] Appl. No.: 751,170

[22] Filed: Aug. 28, 1991

[51] Int. Cl.[5] ..... F23J 7/00; C10L 1/22; C10L 1/24

[52] U.S. Cl. ..... 431/4; 44/301

[58] Field of Search ..... 44/301, 313; 431/38, 431/4, 278

[56] References Cited

U.S. PATENT DOCUMENTS

| | | | |
|---|---|---|---|
| 3,281,438 | 10/1966 | Johnson | 260/404 |
| 3,399,145 | 8/1968 | Martinek et al. | 252/309 |
| 3,490,237 | 1/1970 | Lissant | 60/217 |
| 3,637,357 | 1/1972 | Nixon et al. | 252/308 |
| 3,849,323 | 11/1974 | Hollinshead | 44/301 |
| 3,932,476 | 1/1976 | Bergeron | 260/404 |
| 4,017,522 | 4/1977 | Bailey et al. | 260/347.5 |
| 4,083,698 | 4/1978 | Wenzel et al. | 252/356 |
| 4,158,551 | 6/1979 | Feuerman | 44/301 |
| 4,162,143 | 7/1979 | Yount, III | 252/356 |
| 4,173,455 | 11/1979 | Fodor et al. | 252/309 |
| 4,182,614 | 1/1980 | Moriyama et al. | 252/309 |
| 4,199,326 | 4/1980 | Fung | 252/356 |
| 4,297,107 | 10/1981 | Boehmke | 252/308 |
| 4,378,230 | 3/1983 | Rhee | 44/51 |
| 4,392,865 | 7/1983 | Grosse et al. | 252/312 |
| 4,666,457 | 5/1987 | Hayes et al. | 252/312 |
| 4,696,638 | 9/1987 | Den Herder | 44/301 |
| 4,708,720 | 11/1987 | Grangette et al. | 44/301 |
| 4,725,287 | 2/1988 | Gregoli et al. | 252/314 |
| 4,842,616 | 6/1989 | Verhille | 252/51 |
| 4,960,577 | 10/1990 | Torbov et al. | 423/242 |

FOREIGN PATENT DOCUMENTS

| | | | |
|---|---|---|---|
| 0434109 | 8/1935 | United Kingdom | 44/301 |
| 2109405 | 11/1981 | United Kingdom | 44/301 |

OTHER PUBLICATIONS

Product brochure for PPG Mazer Products, pp. 32, 33, 72; 1988. month unavailable.

Technical Bulletin for Schercomid SO-A, Sep. 1983, Bulletin No. 307-2, Scher Chemicals, Inc., Clifton, N.J.

Technical Bulletin for Schercomid ODA, Aug. 1983, Bulletin No. 331-1, Scher Chemicals, Inc., Clifton, N.J.

Article by Donald T. Brown and Alexander S. Dainoff, 1991 ASME Cogen-Turbo V. Budapest, Hungary, Sep. 3-5, 1991.

*Primary Examiner*—Margaret Medley

*Attorney, Agent, or Firm*—St. Onge Steward Johnston & Reens

[57] ABSTRACT

The invention presented relates to a process for reducing nitrogen oxides emissions from a gas turbine. The process involves forming an emulsion of water and fuel oil and simultaneously combusting the thusly formed emulsion with natural gas in a gas turbine.

14 Claims, 2 Drawing Sheets

REDUCING NITROGEN OXIDES EMISSIONS BY DUAL FUEL FIRING OF A TURBINE

TECHNICAL FIELD

The present invention relates to a process effective for reducing the emissions of nitrogen oxides ($NO_x$, where x is an integer, generally 1 or 2) and visible emissions (particulates or gases which lead to plume opacity) from a gas turbine to the atmosphere.

Gas or combustion turbines have been utilized by many utilities as base load or peaking units to rapidly bring additional electrical generation on line as required and, hence, are preferred for many applications. Unfortunately, the temperatures at which gas turbines operate tend to cause the production of thermal $NO_x$, the temperatures being so high that free radicals of oxygen and nitrogen are formed and chemically combine as nitrogen oxides. Nitrogen oxides are troublesome pollutants and comprise a major irritant in smog. It is further believed that nitrogen oxides can cause or enhance the process known as photochemical smog formation through a series of reactions in the presence of sunlight and hydrocarbons.

Moreover, nitrogen oxides are a significant contributor to acid rain, and have been implicated in adverse environmental and health effects.

Gas turbines have historically been a source of $NO_x$ emissions due to their high combustion temperatures, excess oxygen levels, and pressures, which have been found to accelerate thermal $NO_x$ production. Recently, gas turbines have been designed with the capability of separate water injection into the combustion process, which has been found to be effective in controlling nitrogen oxides formation by reducing peak flame temperatures. Although capable of reducing $NO_x$ emissions to 25 parts per million (ppm) on turbines fired with natural gas, water injection rates equal to or in excess of 1.5× the fuel injection rates are often required.

Such high water injection rates carry with them a substantial penalty. The initial cost to install water injection systems on new units is high, and the cost of a retrofit on existing units is significantly higher. In addition, the cost of the use of demineralized water is substantial and the required high water injection levels can lead to thermal imbalances which result in cracking of the combustion can liners and generally increase maintenance costs and down time of the turbines.

What is desired, therefore, is a process which permits the reduction of effluent nitrogen oxides and plume opacity from a natural gas fired turbine without the drawbacks of separate water injection.

BACKGROUND ART

The use of water in oil emulsions for improving combustion efficiency in turbines has previously been considered. For instance, DenHerder, in U.S. Pat. No. 4,696,638, discusses such emulsions and indicates that the positive effects therefrom include "cleaner exhaust." Although the disclosure of DenHerder refers to emulsions containing up to about 40% water, DenHerder is primarily directed to emulsions having only up to about 10% water in the form of droplets having a diameter of about 1 to about 10 microns.

Recently, Dainoff and Sprague, in U.S. patent application entitled "Process for Reducing Nitrogen Oxides Emissions and Improving the Combustion Efficiency of a Turbine", Ser. No. 07/691,556, filed Apr. 25, 1991, now abandoned for continuation U.S. Ser. No. 07/908,536 the disclosure of which is incorporated herein by reference, have discovered that water-in-fuel oil emulsions up to about 50% water by weight are useful for reducing nitrogen oxides and particulate emissions from combustion turbines. The Dainoff/-Sprague disclosure, though, is directed to those instances when the water-in-fuel oil emulsions are used as the primary fuel for the combustion turbine. They do not address those situations involving turbines being fired primarily with natural gas.

BRIEF DESCRIPTION OF THE DRAWINGS

The present invention will be better understood and its advantages more apparent in view of the following detailed description, especially when read with reference to the appended drawings, wherein.

DISCLOSURE OF INVENTION

Figure 1:
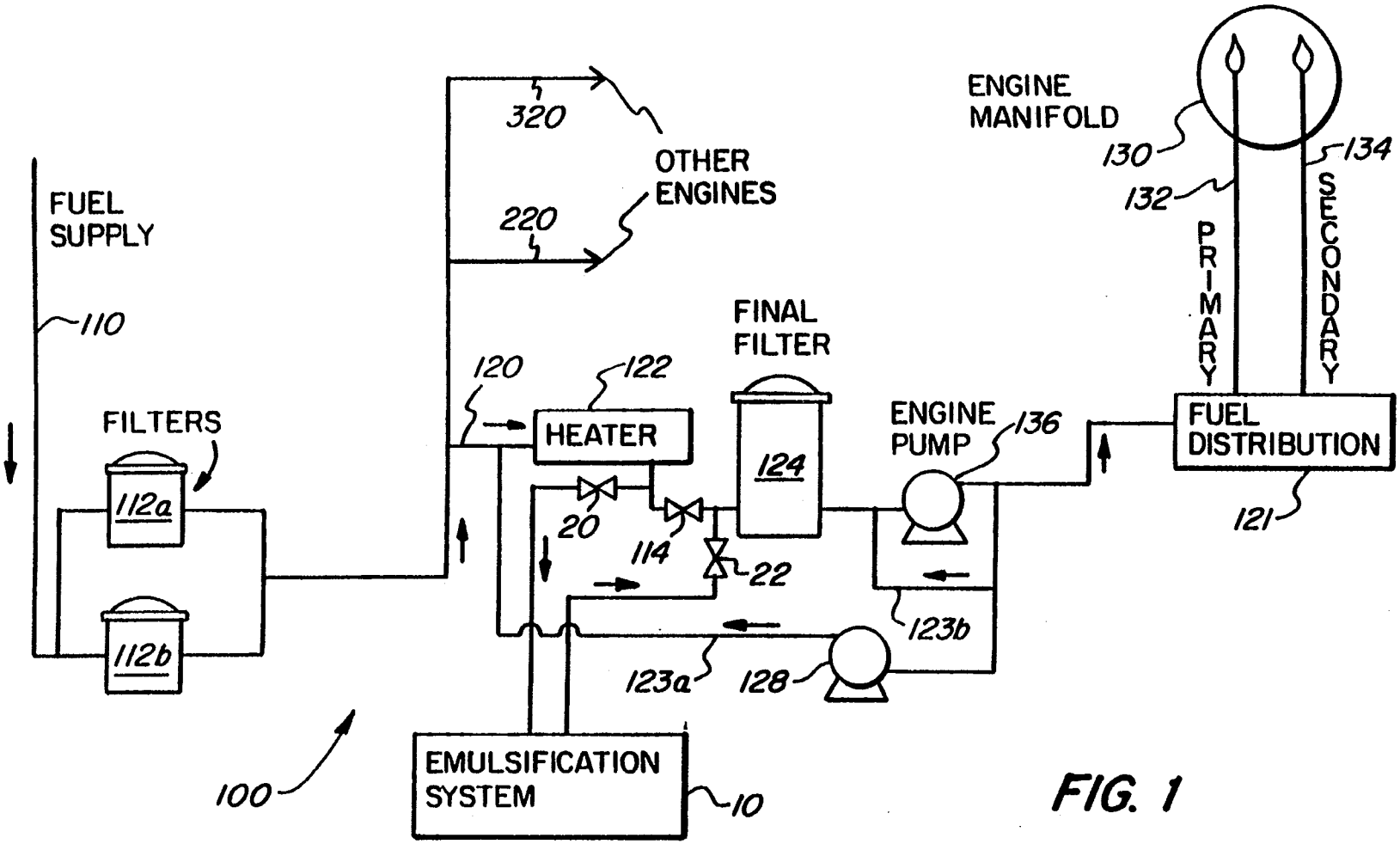
FIG. 1 is a schematic illustration of a representative gas turbine liquid fuel supply system having an emulsification system according to the present invention installed therein.

The present invention relates to a method for reducing nitrogen oxides emissions from a gas turbine (which term will be considered to be interchangeable with combustion turbine) fired with natural gas. In particular, this invention relates to a process involving the formation of a stable water and fuel oil emulsion, where the oil is a light fuel oil such as diesel fuel, distillate fuel, or #2 oil, and simultaneously combusting the emulsion with natural gas. The subject emulsion can be either a water in fuel oil or a fuel oil in water emulsion (although water in fuel oil emulsions are preferred for most applications), and the introduction of the emulsion is into at least one of the combustion cans of the gas turbine through the fuel system.

Natural gas is, in many cases, the fuel of choice for firing gas turbines because of its lower cost as compared with alternative fuels. Many combustion turbines, though, have the capability to fire either natural gas or a liquid fuel such as a light fuel oil, depending on availability and other combustion characteristics. Such a gas turbine can be modified to permit the simultaneous firing of both natural gas and liquid fuel. In the alternative, a turbine designed to fire natural gas alone can be retrofitted to add a liquid fuel system and dual fuel nozzle to thereby permit dual fuel firing.

The emulsion used in the present invention has as its oil phase what is conventionally known as light fuel oils. Light fuel oils contain very little to almost no aromatic compounds and consist of relatively low molecular weight aliphatic and naphthenic hydrocarbons. Such fuels generally comprise diesel fuel, distillate fuel, #2 oil, or #4 oil as defined by the American Society of Testing and Measurement (ASTM) standard specification for fuel oils (designation: D 396-86). Especially preferred are distillate fuels. Included among these are kerosene and jet fuels, both commercial, commonly referred to as Jet A, and military, commonly referred to as JP-4 and JP-5, respectively.

Although demineralized water is not required for the successful control of nitrogen oxides and opacity, the use of demineralized water in the emulsion is preferred in order to avoid the deposit of minerals from the water on the blades and other internal surfaces of the gas turbine. In this way, turbine life is extended and maintenance and outage time significantly reduced.

The emulsions used in the present invention advantageously comprise water in fuel oil emulsions having up to about 92% water by weight. The emulsions of this type which have the most practical significance in combustion applications are those having at least about 40% water and are preferably about 45% to about 87% water in fuel oil by weight. Of course it will be recognized by the skilled artisan that emulsions having up to about 92% water in fuel oil may easily invert into fuel oil in water emulsions which are equally utilizable for the present invention.

Advantageously, the emulsions are prepared such that the discontinuous phase (i.e., the water in a water in fuel oil emulsion and the oil in a fuel oil in water emulsion) has a particle size wherein at least about 70% of the droplets are below about 5 microns Sauter mean diameter. More preferably, at least about 85%, and most preferably at least about 90%, are below about 5 microns Sauter mean diameter.

Emulsion stability is largely related to droplet size. The primary driving force for emulsion separation is the large energy associated with placing oil molecules in close proximity to water molecules in the form of small droplets. Emulsion breakdown is controlled by how quickly droplets coalesce. Emulsion stability can be enhanced by the use of surfactants and the like, which act as emulsifiers or emulsion stabilizers. These generally work by forming repulsive layers between droplets prohibiting coalescence. The gravitational driving force for phase separation is much more prominent for large droplets, so emulsions containing large droplets separate most rapidly.

Smaller droplets also settle, but can be less prone to coalescence, which is the cause of creaming (creaming is a condition recognized by the skilled artisan as a frothy semi-emulsive state). If droplets are sufficiently small, the force of gravity acting on the droplet is small compared to thermal fluctuations or subtle mechanical agitation forces. In this case the emulsion can become stable almost indefinitely, although given a long enough period of time or a combination of thermal fluctuations these emulsions will eventually separate.

Because of the operating characteristics of gas turbines, it is required that the water/fuel oil emulsion exhibit a high degree of stability. In many cases, gas turbines are "peaking" units, as noted, which do not operate regularly. Accordingly, an emulsified fuel may sit stagnant for extended periods or with little recirculation in the fuel line. In order to avoid separation of the emulsion into its components, which can cause slugs of water to be injected through the burner nozzle leading to combustion problems and possible engine damage, an emulsifier or emulsion stabilizer is also desirable in the water/fuel oil emulsion.

Advantageously, the emulsifier utilized comprises a composition selected from one or more alkanolamides, by which is generally meant an amide formed by condensation of an alkyl or hydroxyalkyl amine or mixtures thereof, and an organic acid. Preferred acids are fatty acids, such as lauric acid, linoleic acid, oleic acid, stearic acid, and coconut oil fatty acids. Most preferred are alkanolamides having a molar ratio of alkanolamine group to acid group of from about 1:1 to about 2:1.

Surprisingly, these compositions can stabilize an emulsion of up to about 92% water-in-fuel oil, or up to about 80% fuel oil-in-water in alkanolamide amounts as glow as about 0.05% by weight, and even as low as about 0.01% by weight. In fact, although there is no true maximum amount of emulsifier which can be used, there is usually no need for greater than about 1%, or, in fact, greater than about 0.5% by weight emulsifier in the subject emulsion. Advantageously, to stabilize an emulsion of up to about 92% water-in-fuel oil, the noted alkanolamides should be included in an amount of from about 0.1% to about 0.3% by weight.

Suitable alkanolamides which can function to stabilize the emulsion of the process of the present invention include any one or more of the following: cocamide diethanolamine (DEA), lauramide DEA, poly-oxyethylene (POE) cocamide, cocamide monoethanolamide (MEA), POE lauramide DEA, oleamide DEA, linoleamide DEA, and stearamide MEA, as well as mixtures thereof. Such alkanolamides are commercially available under trade names such as Clindrol 100-0, from Clintwood Chemical Company of Chicago, Ill.; Schercomid ODA, from Scher Chemicals, Inc. of Clifton, N.J.; Schercomid SO-A, also from Scher Chemicals, Inc.; and Mazamide ®, and the Mazamide series from PPG-Mazer Products Corp. of Gurnee, Ill.

Other emulsions which may be useful include ethoxylated alkylphenols, such as nonyl phenol, octyl phenol, etc., and salts of alkylated sulfates or sulfonates, such as sodium lauryl sulfate. In addition, the skilled artisan will recognize that other emulsifiers may be also effective at maintaining the stability of the inventive emulsion.

The use of the noted emulsifiers provides chemical emulsification, which is dependent on hydrophylic-lipophylic balance (HLB), as well as on the chemical nature of the emulsifier. The HLB of an emulsifier is an expression of the balance of the size and strength of the hydrophylic and the lipophylic groups of the composition. The HLB system, which was developed as a guide to emulsifiers by ICI Americas, Inc. of Wilmington, Del. can be determined in a number of ways, most conveniently for the purposes of this invention by the solubility or dispersability characteristics of the emulsifier in water, from no dispersability (HLB range of 1–4) to clear solution (HLB range of 13 or greater). The emulsifiers useful in the present invention should most preferably have an HLB of 8 or less, meaning that after vigorous agitation they form a milky or opaque dispersion in water (HLB range of 6–8), poor dispersion in water (HLB range of 4–6), or show no dispersability in water (HLB range of less than 4).

It is also possible to utilize a physical emulsion stabilizer in combination with the chemical emulsifiers noted above to maximize the stability of the emulsion achieved in the process of the present invention. Use of physical stabilizers also provides economic benefits due to their relatively low cost. Although not wishing to be bound by any theory, it is believed that physical stabilizers increase emulsion stability either by increasing the solubility of immiscible phases or by forming an insoluble barrier attracted to the oil/water interface. Exemplary of suitable physical stabilizers are waxes, cellulose products, and gums, such as whalen gum and xanthan gum.

When utilizing both chemical emulsifiers and physical emulsion stabilizers, the physical stabilizer is present in an amount of about 0.05% to about 5% by weight of the combination of chemical emulsifier and the physical stabilizer. The resulting combination emulsifier/stabilizer can then be used at the same levels noted above for the use of emulsifier alone.

The emulsification provided must be sufficient to maintain the emulsion to a greater extent than if the emulsifier was not present and to as great an extent as possible. The actual level of emulsification will vary depending upon the percentage of oil and water in the emulsion and the particular fuel oil utilized. For example, when the continuous phase is #2 oil, it is highly desired that no more than about 0.1% free water be present in the emulsion, and that the emulsion is maintained that way at ambient conditions for up to at least about two hours or longer. Ambient conditions, that is, the conditions to which the emulsion is expected to be exposed, include the temperature in the gas turbine fuel feed lines. Such temperatures can be up to about 65° C., more typically up to about 90° C. and even as high as about 100° C.

The emulsion used in the process of the present invention can be formed using a suitable mechanical emulsifying apparatus which would be familiar to the skilled artisan. Advantageously, the apparatus is an in-line emulsifying device for most efficiency. The emulsion is formed by feeding both the water and the fuel oil in the desired proportions to the emulsifying apparatus, and emulsifier or stabilizer when used can either be admixed or dispersed into one or both of the components before emulsification or can be added to the emulsion after it is formed.

Preferably, the emulsifier and/or stabilizer is present at the time of emulsifying the water and fuel oil. Most advantageously, any emulsifier or stabilizer used is provided in the water phase, depending on its HLB. It has been found that the emulsions noted above with the chemical emulsifiers can be stabilized at up to about 92% water-in-fuel oil for several days and longer. In fact, with mild agitation, such as recirculation, it is believed that the emulsion can stay in suspension indefinitely.

Surprisingly, the emulsion can then be introduced into the combustion process of a gas turbine through the liquid fuel feed lines and burner nozzles conventionally used with such combustion apparatus while simultaneously introducing and combusting natural gas. There is no need for major modifications to the gas turbine liquid fuel feed lines or combustion can to accommodate the emulsion.

Figure 2:
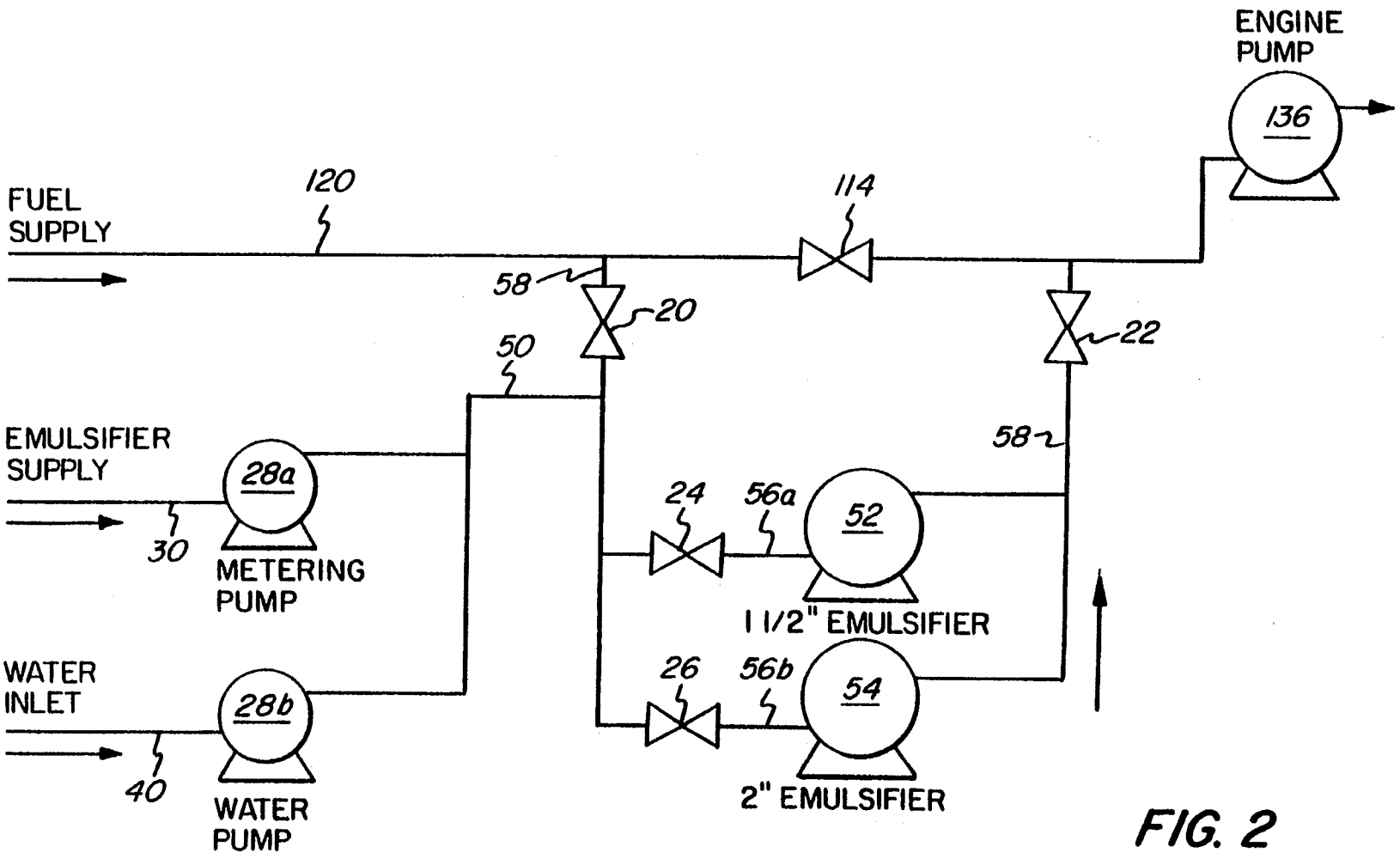
FIG. 2 is a schematic illustration of a representative emulsification system according to the present invention as installed in a gas turbine liquid fuel supply system.

FIGS. 1 and 2 illustrate a representative gas turbine fuel supply system having installed therein an emulsification system for the practice of the process of the present invention and a schematic illustration of the emulsification system itself. As illustrated in FIG. 1, an emulsification system 10 can be installed in a gas turbine fuel supply system 100 between the heater 122 and the final filter 124. Although emulsification system 10 is illustrated as being installed in this position in fuel supply system 100, it will be recognized by the skilled artisan that other positions may be more advantageous in terms of emulsion stability in other fuel supply system embodiments, and emulsification system 10 can be installed at virtually any point along fuel supply system 100 for operability. Indeed, it will also be recognized that heater 122 and final filter 124 are preferred components of fuel supply system 100 and conventionally utilized, but not critically needed.

Fuel supply system 100 is typical of many gas turbine fuel supply systems and generally comprises a fuel supply line 110 which is fed by a fuel tank or other holding or storage apparatus (not shown). Fuel flowing through fuel supply line 110 proceeds through a set of initial filters 112*a* and 112*b*, and is then fed to individual fuel supply systems 120, 220, and 320 which feed engines controlled by fuel supply system 100. For ease of understanding, fuel supply system 120 which feeds engine manifold 130 is specifically illustrated. Supply systems 220 and 320 are equivalent in operation.

Fuel supplied through fuel supply line 110 is fed along engine manifold 130 supply line 120 into heater 122. From there, the fuel flow continues past valve 114 into final filter 124. From final filter 124, the fuel flow continues along line 120 through engine pump 136 and from there into fuel distribution manifold 121 which then supplies the fuel through primary nozzle 132 and secondary nozzle 134 to engine manifold 130, which is the combustion zone of the subject gas turbine. In addition, fuel supply system 110 further comprises recirculation lines 123a and 123 b and recirculation pump 128 for recirculation of the fuel through line 120.

When valve 114 in fuel supply line 120 is closed and valves 20 and 22 in emulsification system 10 are open, fuel flowing along fuel supply line 120 is shunted through emulsification system 10 after heater 122, and is resupplied to fuel supply line 120 before final filter 124 for feeding to engine manifold 130 or recirculation.

As illustrated in FIG. 2, a representative emulsification system 10 comprises an emulsifier supply line 30 which supplies emulsifier from a tank or other storage means (not shown) to a metering pump, and is then fed through line 50. In addition, emulsification system 10 comprises water inlet line 40 which feeds water from a tank or other supply means (not shown) through a water pump 28*a* to supply line 50 where it is admixed with emulsifier supplied from emulsifier supply line 30.

The water/emulsifier fed through line 50 then meets fuel being fed through line 58 when valve 20 is open and valve 114 is closed. These are then fed through either one or both of 1½ inch emulsifier 52 or 2 inch emulsifier 54, depending on whether one or both of valves 24 or 26 is open through feed lines 56*a* and 56*b*, respectively. The emulsified water-in-fuel oil is then fed via line 58 back through fuel supply line 120 when valve 22 is open and from there into engine pump 136 and into engine manifold 130.

Although not wishing to be bound by any theory, it is believed that the use of the emulsion along with natural gas comprises striking advantages over separate water injection systems because the water is provided internal to the flame (that is, the flame is formed in part by the water-bearing element). By doing so, less water is required to achieve superior results which reduces the deleterious effects of directly introducing large amounts of water into the combustion process. Accordingly, the reduced use of demineralized water and less thermal stress is provided.

Additionally, use of the water/fuel oil emulsion as an adjunct to combustion of natural gas results in substantial elimination of the need for an expensive, independent, smoke suppressant additive. Typically, such additives are heavy metal based products which can form deposits on the turbine blades, reducing efficiency and increasing maintenance costs. In addition, these additives are discharged to the atmosphere with possible attendant adverse environmental and health effects. By the use of emulsions and the process of this invention, a 90% or greater reduction in smoke suppressant additive use is often achieved, which increases the blade life due to reduced deposits, and creates less wear on the turbine blade coatings. These advantages all lead to significant savings in operating and maintenance costs.

Furthermore, when compared to a separate water injection system, use of the inventive process leads to improved engine fuel system integrity; the engine burns cooler, which as noted, leads to less thermal stress; it is believed that the gas turbine can assume a higher load capacity; and compliance with environmental regulations is more easily obtainable.

The following example further illustrates and explains the invention.

EXAMPLE I

A Turbo Power and Marine Company (TP and M) Model A-9 gas turbine operating as part of a twinpak rated at approximately 33 megawatts which is designed to operate on either 100% gas or 100% distillate fuel oil is modified to allow the unit to operate on both fuels simultaneously. An emulsification system comprising two rotary emulsifiers and related storage pumping and piping apparatus for preparation and supply of a water in fuel oil emulsion is installed on the distillate fuel oil line just ahead of the last chance filter through a by-pass valve arrangement.

Baseline data is obtained by firing natural gas alone and then a 50/50 mixture of natural gas and distillate fuel oil for comparison. The unit is then run with water in fuel oil emulsions using various emulsion levels and fuel oil feed rates. The results are set out in Table 1 (the final nitrogen oxides values are each corrected to oxygen).

TABLE 1

| % Emulsion | Water GPM | Oil GPM | NO | NOx | Corrected NOx | % NOx Reduction | % Oil BTU'S Fired |
|---|---|---|---|---|---|---|---|
| 0.0 | 0.0 | 0.0 | 59 | 71 | 104 | 0.0 | 0.01 |
| 0.0 | 0.0 | 11.7 | 71 | 84 | 126 | 0.0 | 44.7 |
| 50.6 | 10.5 | 10.3 | 32 | 43 | 68 | 46.0 | 39.3 |
| 49.8 | 7.5 | 7.6 | 42 | 53 | 80 | 36.5 | 29.4 |
| 48.1 | 4.4 | 4.8 | 42 | 58 | 87 | 30.9 | 18.5 |
| 55.0 | 12.0 | 9.8 | 26 | 40 | 60 | 52.4 | 38.2 |
| 70.1 | 14.0 | 6.0 | 21 | 34 | 50 | 60.3 | 23.2 |
| 83.0 | 16.0 | 3.3 | 15 | 28 | 34 | 73.0 | 12.8 |
| 73.9 | 17.8 | 6.3 | 12 | 25 | 37 | 70.6 | 24.1 |
| 85.9 | 20.0 | 3.3 | 7 | 19 | 29 | 77.0 | 12.4 |

Table 1 illustrates the fact that excellent reductions in nitrogen oxides are obtained when a gas turbine is fired using both natural gas and a water in fuel oil emulsion simultaneously.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

We claim:

1. A process for reducing nitrogen oxides emissions from a gas turbine, comprising forming an emulsion of water and fuel oil which comprises a water-in-fuel oil emulsion having up to about 92% water by weight or a fuel oil-in-water emulsion having up to about 80% fuel oil by weight, and simultaneously combusting said emulsion and natural gas in a gas turbine.

2. The process of claim 1, wherein said fuel oil is selected from the group consisting of distillate fuel, kerosene, jet fuel, diesel fuel, and #2 oil.

3. The process of claim 2, wherein said emulsion comprises up to about 92% water-in-fuel oil.

4. The process of claim 1, wherein said emulsion further comprises an emulsifier having an HLB of 8 or less in an amount of about 0.01% to about 1.0% by weight.

5. The process of claim 4, wherein said emulsifier comprises:

a) ethoxylated alkylphenols,
b) alkylated sulfates,
c) alkylated sulfonates,
d) alkanolamides formed by condensation of:
  i) an alkyl or hydroxy alkyl amine, or mixtures thereof and
  ii) an acid, or mixtures thereof.

6. The process of claim 5, wherein said emulsifier comprises an alkanolamide present in an amount of about 0.05 to about 0.3% by weight.

7. The process of claim 5, wherein said emulsifier further comprises an emulsion stabilizer in an amount of about 0.05% to about 5% emulsion stabilizer is selected from the group consisting of waxes, cellulose products, gums, and mixtures thereof.

8. A process for reducing nitrogen oxides emissions from a gas turbine, comprising forming an emulsion of up to about 92% water in fuel oil and simultaneously combusting said emulsion with natural gas in a gas turbine.

9. The process of claim 8, wherein said fuel oil is selected from the group consisting of distillate fuel, kerosene, jet fuel, diesel fuel, and #2 oil.

10. The process of claim 9, wherein said emulsion comprises between about 40% to about 87% water-in-fuel oil.

11. The process of claim 8, wherein said emulsion further comprises an emulsifier having an HLB of 8 or less in an amount of about 0.01% to about 1.0% by weight.

12. The process of claim 11, wherein said emulsifier comprises:

a) ethoxylated alkylphenols,
b) alkylated sulfates,
c) alkylated sulfonates,
d) alkanolamides formed by condensation of:
  i) an alkyl or hydroxy alkyl amine, or mixtures thereof and
  ii) an acid, or mixtures thereof.

13. The process of claim 12, wherein said emulsifier comprises an alkanolamide present in an amount of about 0.05 to about 0.3% by weight.

14. The process of claim 12, wherein said emulsifier further comprises an emulsion stabilizer in an amount of about 0.05% to about 5% by weight, wherein said emulsion stabilizer is selected from the group consisting of waxes, cellulose products, gums, and mixtures thereof.

* * * * *

UNITED STATES PATENT AND TRADEMARK OFFICE

CERTIFICATE OF CORRECTION

PATENT NO. : 5,344,306

DATED : September 6, 1994

INVENTOR(S) : Donald T. Brown, et al

It is certified that error appears in the above-indentified patent and that said Letters Patent is hereby corrected as shown below:

Column 4, line 4, "glow as about" should read —low as about—.

Column 7, line 32, insert —15%— immediately after "corrected to".

Signed and Sealed this

Third Day of January, 1995

Bruce Lehman

*Attest:*

BRUCE LEHMAN

*Attesting Officer*

*Commissioner of Patents and Trademarks*